US011744770B2

(12) United States Patent
Radovic

(10) Patent No.: US 11,744,770 B2
(45) Date of Patent: Sep. 5, 2023

(54) VIBRATING THERAPEUTIC APPAREL

(71) Applicant: VIBRATING THERAPEUTIC APPAREL, LLC, Wilmington, DE (US)

(72) Inventor: Amira Idris Radovic, Wilmington, DE (US)

(73) Assignee: Vibrating Therapeutic Apparel, LLC, Wilmington, DE (US)

( * ) Notice: Subject to any disclaimer, the term of this patent is extended or adjusted under 35 U.S.C. 154(b) by 297 days.

(21) Appl. No.: 17/307,670

(22) Filed: May 4, 2021

(65) Prior Publication Data

US 2021/0251844 A1 Aug. 19, 2021

Related U.S. Application Data

(63) Continuation-in-part of application No. 16/021,613, filed on Jun. 28, 2018, now abandoned, which is a (Continued)

(51) Int. Cl.

| | |
|---|---|
| ***A61H 23/02*** | (2006.01) |
| ***A41D 1/00*** | (2018.01) |
| ***A61H 9/00*** | (2006.01) |

(52) U.S. Cl.

CPC ..... *A61H 23/02* (2013.01); *A41D 1/005* (2013.01); *A61H 9/0092* (2013.01); (Continued)

(58) Field of Classification Search

CPC .. A61H 23/02; A61H 23/0263; A61H 9/0092; A61H 2201/0103;

(Continued)

(56) References Cited

U.S. PATENT DOCUMENTS 4,922,893 A * 5/1990 Wright ..... A61H 9/0078 601/152

5,274,885 A 1/1994 Hellweg (Continued)

FOREIGN PATENT DOCUMENTS

WO WO 2009-044400 A2 4/2009

WO WO 2010-028042 A1 3/2010

(Continued)

*Primary Examiner* — Justine R Yu

*Assistant Examiner* — Kelsey E Baller

(74) *Attorney, Agent, or Firm* — Devlin Law Firm LLC

(57) ABSTRACT

A therapeutic apparel article is configured with a supple wearable fabric article that can be configured over limb or nub of an amputated limb. The therapeutic apparel article is configured with a plurality of nodes for detachably attaching vibrating devices thereto. In addition, a control unit having a power source may be detachably attached to the wearable fabric article. A conductive network may extend from the control unit and/or the power source to provide electrical power to the nodes and the vibrating devices attached. A user may attach vibrating devices to various nodes of the wearable fabric article as desired. In addition, the vibrating devices and the control unit can be detached from the wearable fabric article to enable the wearable fabric article to be washed.

19 Claims, 13 Drawing Sheets

Related U.S. Application Data continuation-in-part of application No. 15/367,090, filed on Dec. 1, 2016, now abandoned.

(60) Provisional application No. 62/320,031, filed on Apr. 8, 2016, provisional application No. 62/526,178, filed on Jun. 28, 2017.

(52) U.S. Cl.
CPC ... *A61H 23/0263* (2013.01); *A41D 2400/322* (2013.01); *A41D 2500/10* (2013.01); *A41D 2500/20* (2013.01); *A61H 2201/0103* (2013.01); *A61H 2201/1207* (2013.01); *A61H 2201/165* (2013.01); *A61H 2201/1685* (2013.01); *A61H 2201/5023* (2013.01); *A61H 2201/5038* (2013.01); *A61H 2201/5043* (2013.01); *A61H 2205/06* (2013.01); *A61H 2205/08* (2013.01); *A61H 2205/10* (2013.01)

(58) Field of Classification Search
CPC ..... A61H 2201/1207; A61H 2201/165; A61H 2201/1685; A61H 2201/5023; A61H 2201/5038; A61H 2201/5043; A61H 2205/06; A61H 2205/08; A61H 2205/10; A41D 1/005; A41D 2400/322; A41D 2500/10; A41D 2500/20
See application file for complete search history.

(56) References Cited

U.S. PATENT DOCUMENTS

| | | | |
|---|---|---|---|
| 6,093,134 | A | 7/2000 | Worsham |
| 6,093,164 | A | 7/2000 | Davis et al. |
| 6,223,565 | B1 | 5/2001 | Cooper |
| 6,319,015 | B1 | 11/2001 | Faunce |
| 8,523,793 | B1 | 9/2013 | Waldon, Sr. |
| 8,948,876 | B2 | 2/2015 | Gozani et al. |
| D754,355 | S | 4/2016 | Ganapathy et al. |
| 9,468,762 | B2 | 10/2016 | Kishawi et al. |
| 9,474,898 | B2 | 10/2016 | Gozani et al. |
| 9,656,070 | B2 | 5/2017 | Gozani et al. |
| 9,675,801 | B2 | 6/2017 | Kong et al. |
| 9,731,126 | B2 | 8/2017 | Ferree et al. |
| 9,827,420 | B2 | 11/2017 | Ferree et al. |
| 2004/0260211 | A1 | 12/2004 | Maalouf |
| 2007/0027411 | A1 | 2/2007 | Ella et al. |
| 2008/0108914 | A1 | 5/2008 | Brouqueyre et al. |
| 2008/0288007 | A1 | 11/2008 | Malak |
| 2010/0249637 | A1 | 9/2010 | Walter et al. |
| 2010/0268130 | A1 * | 10/2010 | Khan ..... A61H 9/0078 601/150 |
| 2011/0054576 | A1 | 3/2011 | Robinson et al. |
| 2013/0184623 | A1 | 7/2013 | Fraser |
| 2014/0207219 | A1 | 7/2014 | Dunbar et al. |
| 2016/0030281 | A1 | 2/2016 | Shafieloo |
| 2016/0181729 | A1 | 6/2016 | Barth et al. |
| 2016/0228325 | A1 | 8/2016 | Kologrivov et al. |

FOREIGN PATENT DOCUMENTS

| | | | |
|---|---|---|---|
| WO | WO 2012-156052 | A2 | 11/2012 |
| WO | WO 2016-051414 | A1 | 4/2016 |
| WO | WO-2022130382 | A1 * | 6/2022 |

* cited by examiner

VIBRATING THERAPEUTIC APPAREL

CROSS REFERENCE TO RELATED APPLICATIONS

This application is a continuation in part of U.S. patent application Ser. No. 16/021,613, filed on Jun. 28, 2018 and currently pending which is a continuation in part of U.S. patent application Ser. No. 15/367,090, filed on Dec. 1, 2016 and now abandoned, which claims the benefit of priority to U.S. Provisional Application No. 62/320,031, filed on Apr. 8, 2016, and application Ser. No. 16/021,613, claims the benefit of priority to U.S. Provisional Patent Application No. 62/526,178, filed on Jun. 28, 2017; the entirety of each of which is hereby incorporated by reference herein.

FIELD OF THE INVENTION

The invention is directed to therapeutic apparel having a vibrating device and particular to sleeves and socks configured to reduce phantom limb pain

BACKGROUND

Amputees experience phantom limb pain (PLP), a painful sensation that seems to be coming from the amputated limb. The pain occurs soon after surgery and can manifest as a twisting, burning, itching or pressure sensation. This PLP can last for several second to minutes, to hours or even days. Phantom limb pain usually diminishes during the first six months after surgery but may continue to occur for years. Phantom limb pain may emanate from various locations on the nub.

There are a number of medications that can be used to treat PLP including, acetaminophen, opioids, antidepressants, anticonvulsants, beta-blockers, muscle relaxants. Many of these medications come with undesirable side effects however. Some non-medication treatments include acupuncture, massaging of the residual limb, transcutaneous electrical nerve stimulation (TENS), biofeedback and use of a shrinker. These non-medical treatment options require an amputee to go out of their way for treatment, stop their activities and plug in a device, for example.

In addition, amputees typically have a lot of sensitivity to contact from the amputation site that is uncomfortable. Patients have to go through desensitization procedures to slowly become comfortable with contact. These procedures include rubbing the amputation site with fabrics and progressively more abrasive materials.

There exists a need for a treatment device that can be used to treat phantom limb pain and improve the desensitization process that is quick and effective and that is portable. There also exists a need for a treatment device that enables a user to select the area for treatment

SUMMARY OF THE INVENTION

The invention is directed to a therapeutic apparel article system comprising a wearable fabric article that may be a sock or a sleeve configured to be donned over a limb, such as an amputated or residual limb. The therapeutic apparel article system may include mechanical stimulation, wherein vibrating devices provide mechanical stimulation to a body part, thermal stimulation, wherein the wearable article comprises an inflatable bladder that can be filed with a heated or cooled fluid, and visual stimulation, wherein a light or plurality of lights are configured on the wearable apparel article and configured to produce a light display that distracts a wearer of the apparel article from pain and discomfort. The therapeutic apparel article comprises a plurality of nodes, wherein each node comprises a node attachment for detachable attaching a vibrating device. A user or wearer of an exemplary therapeutic apparel article may elect to attach one or more vibrating devices to the nodes as desired. In addition, in an exemplary embodiment, a control unit comprising a power source, such as a battery, is detachably attachable to the wearable fabric article. A conductive network may extend from the control unit and/or the power source to the nodes, for the delivery of electrical power to the vibrating devices, through the nodes. A control unit may comprise a user input feature for controlling the vibrating device function such as, powering the vibrating devices off/on, controlling the vibrating level or intensity, and/or controlling the vibrating frequency or mode, such as oscillating more, ramping mode, random mode and the like. A wearable article may be configured as a glove or any other article for donning on or over part of the body. In one embodiment, the wearable article is wrapped around or over part of the body to form a sleeve or sock.

In an exemplary embodiment, the wearable fabric article is a supple article that can be folded over upon itself without damage. A user of the therapeutic apparel article may detach the vibrating device and the control unit and wash the wearable fabric article without damage, for example. In this way, a user may wash the therapeutic apparel article after use. The wearable fabric article may be made from fabric, such as a knitted or woven fabric. In a preferred embodiment, the fabric is a seamless fabric, wherein there are no seams that might cause irritation to a wearer. An exemplary wearable fabric article may comprise one or more layers, such as one or more layers of fabric or a synthetic material such as foam, an elastomeric material and the like. A synthetic material may comprise an elastomeric material including, but not limited to elastomeric foam, such as urethane or silicone foam. An exemplary wearable article may provide some compression when fitted on or over a limb. The wearable article may be elastomeric, wherein it can be stretched and upon removal of a tensile load, return substantially to an original shape. For example, a sock or sleeve may stretch to extend over a nub or limb and provide a compressive force and when removed it may then shrink back and return to an original shape or dimension. In an exemplary embodiment, a wearable fabric article comprises an inner layer, an outer layer and a conductive network extending therebetween.

An exemplary conductive network comprises one or more electrical leads that extend along the wearable fabric article and carry electrical current from the power source to the nodes. A vibrating device can then be attached to the node to receive said power for operation. The electrical leads may be insulated electrical wires that are woven into a fabric or fabric layer or extend between layers of the wearable fabric article. In an exemplary embodiment, electrical leads of the conductive network extend between an inner layer and an outer layer of the wearable fabric article, such as between woven fabric layers, between a synthetic layer and a fabric layer, or two synthetic layers. In another exemplary embodiment, the conductive network or the electrical leads are interwoven with a fabric. The conductive network or electrical leads are connected electrically with the nodes to supply power to the detachable vibrating devices. A conductive network may comprise conductive fabric that is interwoven with the wearable article and may comprise two separate layers of conductive fabric that are separated by a non-conductive layer. One of the conductive fabric layers may provide electrical current to a node and the other conductive fabric layer may be an electrical return from the node to the power source.

A node for attachment of a vibrating device may be comprise any conventional detachable attachment mechanism including a snap or snaps wherein a mating snap on the vibrating device are configured to be pressed to and couple with the node snaps. In an exemplary embodiment, a node is a locking attachment node, requiring at least two separate motions to attach and lock the vibrating device to the node. For example, the vibrating device may require insertion and then rotation to lock the vibrating device to the node. In an exemplary embodiment, a node comprises an electrical supply portion and an electrical return portion and the vibrating device comprises an electrical supply and electrical return portions. In another embodiment, a node comprises a conductive patch, such as a conductive fabric. A node may comprise hook-and-loop fastener material and the vibrating device may comprise hook-and-loop fastener material for detachably attaching thereto. A hook-and-loop fastener material may comprise a conductive element or be an electrically conductive fabric.

A control unit may also be detachably attachable to the wearable fabric article. A control unit may comprise an interface for connecting to the wearable fabric article. The wearable fabric article may comprise a controller interface that is configured to receive the control unit interface. For example, a control unit may snap on to a matching snap or snaps or may comprise terminal that plug into a receptacle of the controller interface, for example. A power source configured with the control unit, such as a battery, may supply electrical power to the conductive network and the vibrating devices through the controller interface. A user may turn the vibrating devices on and off through a user interface of the control unit. A user may change the output of the vibrating devices through the user interface of the control unit. For example, a user may want to increase the vibration or change the frequency of vibration and may use the user interface to change these vibrating device outputs.

An exemplary vibrating device may employ an electrical motor that spins an eccentric mass, or an ERM motor. ERM motors are rotary motors with attached eccentric mass at a fixed amplitude. As current is supplied to the motor, it spins up and vibration is created as the eccentric mass rotates. Vibrations are transmitted through the motor, and into the device, which causes the motor to wear out rapidly. An exemplary vibrating device may employ a piezoelectric device that produces vibration. A controller may have a user input feature to all adjustment of the intensity or frequency of vibration. An exemplary vibration device may operate in a frequency range of between about 20 and 200 Hz, which has been shown to reduce phantom limb pain.

A controller may allow a user to set a vibration time, such as about 5 minutes or more and may provide a display screen to show time, remaining time, frequency and/or intensity. A user may set a desired vibration time and desired frequency for treatment.

An exemplary therapeutic apparel article may comprise a control and/or power source that is detachably attachable to the wearable fabric article. An exemplary controller may clip or snap into a docking station that is coupled to the fabric article. In an exemplary embodiment a docking retainer is configured between the outer and inner fabric layers and retains the docking station to the outside fabric layer, through fasteners that extend through the outer fabric layer. In addition, a plurality of pockets may be configured between the inner and outer layers of the fabric article to allow a user to place vibrating devices in a desired location. The vibration device of devices may be connected to the controller through an electrical lead that may detachably attach to the docking retainer, by an electrical connector. In this way, a user may detach the power source, controller and vibrating device as well as the electrical leads from the fabric article to allow washing of the fabric article. A fastener, such as snaps, a zipper, or a hook-and-loop fastener may couple the outer and inner fabric layers together and enable access between these layers for placement of the vibrating devices and/or removal for washing.

The exemplary therapeutic apparel article may comprise an inflatable bladder, also referred to as an inflatable cuff, that can be inflated to a desired pressure to secure the apparel article to a limb or around a person and to apply compression to the limb or a portion of the limb. A user may interface with an inflator to inflate the inflatable bladder to a desired pressure. An exemplary inflator may be a manual pump, such as a diagram that can be squeezed to inflate the inflatable bladder or a pump that is powered by a power source. In an exemplary embodiment, the pump is configured with the controller and receives power from a battery. An exemplary bladder of an inflatable bladder may be configured on an outer portion of the apparel article or sleeve to create a force that presses the vibrating devices against the user. This increased force of the vibrating device against the user may enhance and improve effectiveness of the device. An inflatable bladder may extend along a portion of the therapeutic apparel article or may extend substantially over the entire apparel article. In an exemplary embodiment, the inflatable bladder is configured to extend around a user's limb to compress the limb or a portion thereof. In another embodiment, an inflatable bladder is configured outside, or in an outer location with respect to the vibrating device, and produces a force on the vibrating device that presses the vibrating device against the user when in use with the inflatable bladder inflated.

The inflatable bladder may be filled with a fluid and this fluid may be heated to provide thermal stimulation, such as being cold and preferably heated. The fluid may be heated above ambient temperature and may be heated above body temperature, or above about 38° C., and may be heated to about 40° C. or more, about 42° C. or more, 45° C. or more, about 50° C. or more and any range between and including the temperature values provided.

By applying a peripheral stimulus like vibration to the pain site of an amputated limb, the pain signals can be overridden and disrupted. For example, vibrations can trigger primary sensory receptors located in the human skin that can override pain signals. There are four primary sensory receptors known as mechanoreceptors, which sense touch, pressure, and distortion (stretch). These receptors include the Merkel's disk, Meissner's corpuscles, Ruffini endings, and Pacinian corpuscles. Studies have shown that these deep and superficial mechanoreceptors are sensitive to both vibration frequency and amplitude. For example, it is known that Meissner corpuscles respond to light touch and can adapt rapidly to changes in texture and vibrations around 50 Hz while, Pacinian corpuscles are located deep in the skin's fascia and can detect rapid vibrations of about 200-300 Hz. Furthermore, it has been shown that these receptors are highly sensitive to combinations of different magnitudes of vibration frequencies and amplitudes. However, due to lack of adequate and accurate vibrating devices, there are contradictory clinical results in literature in regards about what should be optimal vibration therapy for treating neuropathic pain. Mechanical stimulation therapy is highly individualized process, meaning that each person has its own unique combination of vibration frequencies and amplitudes that triggers mechanoreceptors to inhibit pain signals.

However, the problem of solving phantom limb pain using current vibrating devices for pain treatments lays in the fact that their design is inadequate and not suitable for clinical practice. Most vibrating motors that are currently used in therapeutic markets have very unreliable vibration outputs or they provide very limited range of amplitudes and frequencies. Not a single, currently available medical vibrating device is capable of supplying, accurately and simultaneously, vibration frequencies in a range of 50-300 Hz and amplitudes in 0-3 G. The proposed smart vibrating motor will provide a wider range of vibration frequencies and varying amplitudes, and provide vibration therapy that could be personalized, to fit the needs of targeted patients. A smart vibrating device is a vibrating device that has separate control of frequency and amplitude.

An exemplary smart vibrating device is a linear resonance actuator (LRA) that integrates a shape memory alloy (SMA) spring to improve actuator performance, and enable changing of the spring stiffness through a heater. Changing the stiffness of the shape memory alloy spring enables control and optimize vibration output within a wide range of vibration frequencies and amplitudes. Through a change in temperature of the shape memory alloy, the spring stiffness properties are manipulated, and the frequency and amplitude ranges of the vibrating motor can be significantly increased. The exemplary vibrating motor allows for resonant vibration frequency shift and transformation in the same system. This will provide a wider range of LRA motor's vibration frequencies and amplitudes available for personalize vibration therapy drug-free pain treatment.

A shape memory alloy may include any number of alloys but the two most common shape-memory alloys are copper-aluminum-nickel and nickel-titanium (NiTi). Other SMAs include alloys of zinc, copper, gold and iron. Some examples of iron and copper SMAs include, but are not limited to, Fe—Mn—Si, Cu—Zn—Al and Cu—Al—Ni, and are cheaper than NiTi, NiTi-based SMAs. NiTi, NiTi SMAs may be preferred for this application however due to their superior thermo-mechanic performance. SMAs can exist in two different phases, with three different crystal structures (i.e. twinned martensite, detwinned martensite and austenite) and six possible transformations. Shape memory alloys have a change in crystal structure at one or more transition temperatures.

An LRA may preferably operate at a frequency that is a resonance frequency of the spring and with a shape memory alloy this resonance frequency can be changed by heating. A shape memory alloy may provide small, medium or high dampening as a result of the heat state and crystal structure resulting therefrom.

A heater is configured to heat the SMA to change or modify the stiffness of the SMA, by having changes phases and crystal structure. A heater may include a resistive heater, a radiant heater, an inductive heater and any combination thereof. A heater may be configured around the SMA spring, within the a SMA coil and may be insulated or configured within an enclosure to prevent the heat from damaging other components or from heating the exterior of the vibrating device.

Any of the vibrating devices or motors as described herein may be a linear resonance actuator which may incorporate a shape memory alloy spring to enable separate control of the frequency and amplitude. To overcome the limitations of existing vibratory devices used to manage and treat neurological pain, a smart linear resonance actuator, is described herein. When describing vibration, vibration frequency and amplitudes are two main vibration parameters used. With vibration therapy, these parameters are crucial in understanding how vibration affects the body's response to such treatment. What makes a linear resonance actuator (LRA) ideal for vibration therapy is the decoupling of vibration amplitude and frequency. An LRA uses a mass spring system, where a small mass and magnet attached to a spring moves in a linear fashion to create force when driven by a voice coil. An LRA's design is similar to that of a loudspeaker, however, instead of a cone that generates sound pressure waves, there is a mass that generates vibrations. When driven properly, using an alternating current, to produce an alternating driving signal, LRA motors can be highly efficient and provide good acceleration. The ability to miniaturize these motors down to a few millimeters enables their use in an exemplary therapeutic apparel article.

Typically, LRA vibrating motors must be driven at a narrow band (±2 Hz) around the resonant frequency because of the spring constant, which is governed by steel spring stiffness (Youngs Modulus). Due to its rigid molecular architecture, steel stiffness is invariable to change in temperature or pressure. When the input signal frequency is moved too far from the resonant frequency, the vibration performance and frequency vs. amplitude, can drop off significantly. Unfortunately, this narrow operating bandwidth centered around the resonant frequency of steel makes current LRA's unsuitable for research on vibration therapy pain management and hinders the commercial potential of vibration therapy as a reliable medical modality for pain treatment.

An exemplary linear resonance actuator incorporates a shape memory alloy spring, that is heated by a heater to change the stiffness of the spring and therefore change the amplitude and/or frequency of vibration. An electromagnet creates a magnetic force on the actuator mass via a voice coil 109. The actuator mass is actuated back and forth by the changing magnetic field and the shape memory alloy spring is configured between the actuator mass and the end plate to translate the motion to the end plate. A change in the stiffness of the spring will change the frequency and/or amplitude of motion of the end plate. A heater is controlled by the heater controller and may be used to adjust the temperature of the shape memory alloy spring and therefore the stiffness. A barrier sleeve 105 extends around the heater and a thermal insulation layer is configured between the barrier sleeve and an actuator cover. The voice coil controller controls the voice coil to change the frequency and magnitude of the magnetic field.

A linear resonance actuator may be coupled with a controller that has separate user input features for frequency and amplitude. An exemplary user input feature on the controller may have an amplitude user input feature that has an amplitude up and an amplitude down control button and a frequency user input feature that has a frequency up and a frequency down control button. The frequency and amplitude of the output vibration of the LRA may be changed by the change in spring stiffness, or spring constant, as a function of changing the temperature of the shape memory alloy spring.

The summary of the invention is provided as a general introduction to some of the embodiments of the invention and is not intended to be limiting. Additional example embodiments including variations and alternative configurations of the invention are provided herein.

BRIEF DESCRIPTION OF SEVERAL VIEWS OF THE DRAWINGS

The accompanying drawings are included to provide a further understanding of the invention and are incorporated in and constitute a part of this specification, illustrate embodiments of the invention, and together with the description serve to explain the principles of the invention.

DETAILED DESCRIPTION OF THE ILLUSTRATED EMBODIMENTS

Figure 1:
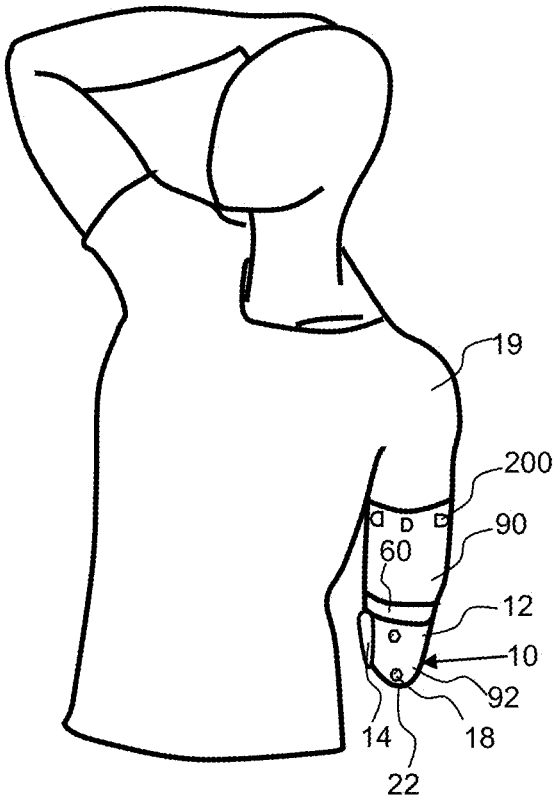
FIG. 1 shows a person with an amputated arm donning a therapeutic apparel article as described herein.

Corresponding reference characters indicate corresponding parts throughout the several views of the figures. The figures represent an illustration of some of the embodiments of the present invention and are not to be construed as limiting the scope of the invention in any manner. Further, the figures are not necessarily to scale, some features may be exaggerated to show details of particular components. Therefore, specific structural and functional details disclosed herein are not to be interpreted as limiting, but merely as a representative basis for teaching one skilled in the art to variously employ the present invention.

As used herein, the terms "comprises," "comprising," "includes," "including," "has," "having" or any other variation thereof, are intended to cover a non-exclusive inclusion. For example, a process, method, article, or apparatus that comprises a list of elements is not necessarily limited to only those elements but may include other elements not expressly listed or inherent to such process, method, article, or apparatus. Also, use of "a" or "an" are employed to describe elements and components described herein. This is done merely for convenience and to give a general sense of the scope of the invention. This description should be read to include one or at least one and the singular also includes the plural unless it is obvious that it is meant otherwise.

In cases where the present specification and a document incorporated by reference include conflicting and/or inconsistent disclosure, the present specification shall control.

Certain exemplary embodiments of the present invention are described herein and are illustrated in the accompanying figures. The embodiments described are only for purposes of illustrating the present invention and should not be interpreted as limiting the scope of the invention. Other embodiments of the invention, and certain modifications, combinations and improvements of the described embodiments, will occur to those skilled in the art and all such alternate embodiments, combinations, modifications and improvements are within the scope of the present invention.

Figure 2:
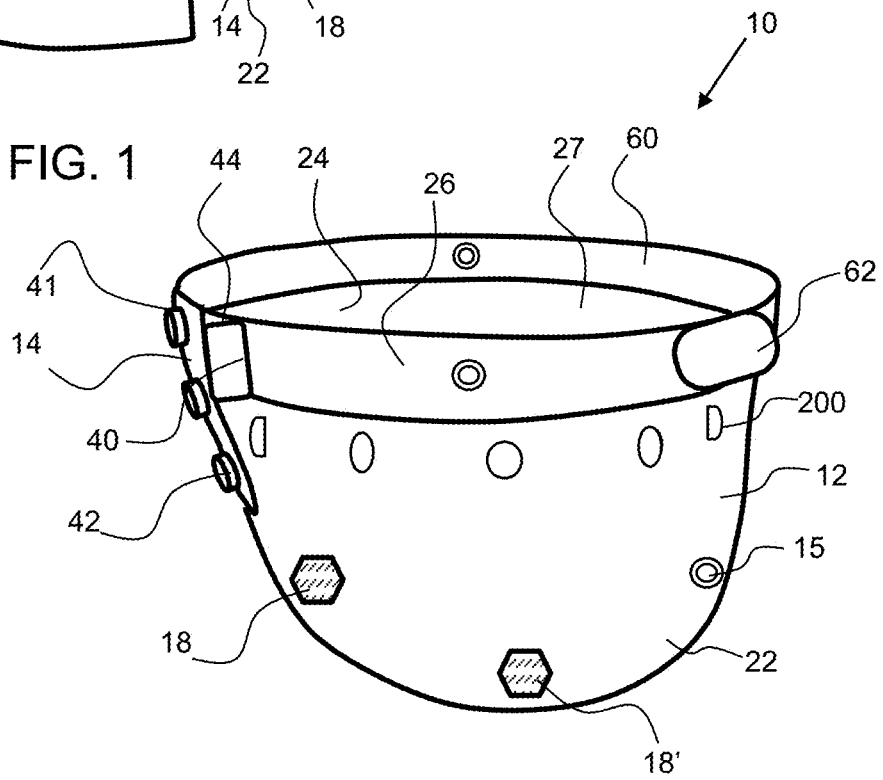
FIG. 2 shows an exemplary therapeutic apparel article having a control unit and a plurality of nodes and vibrating devices attached thereto.
Figure 3:
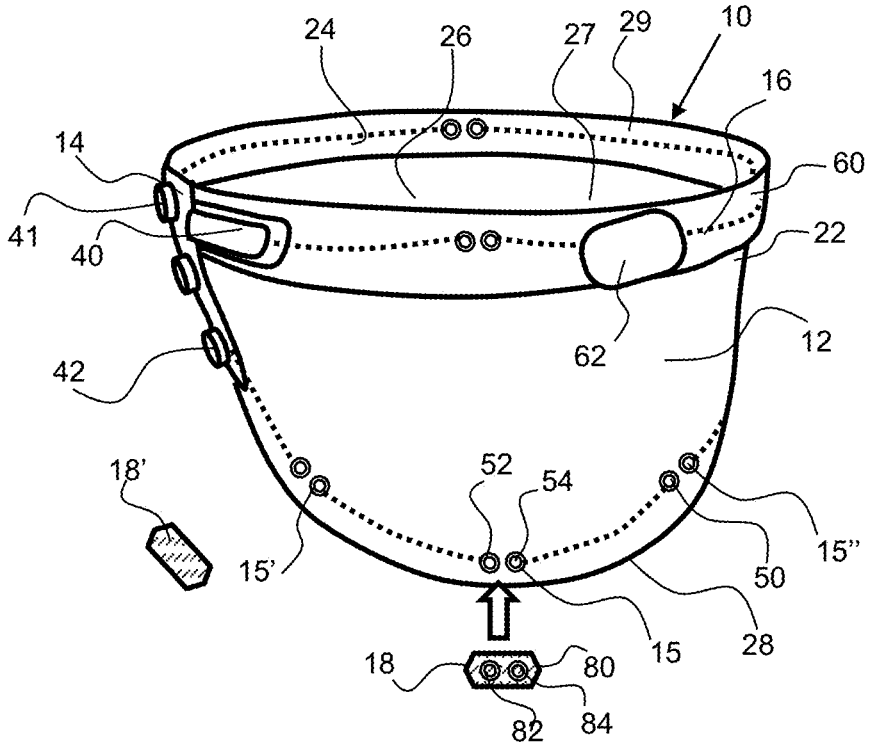
FIG. 3 shows an exemplary therapeutic apparel article having a control unit, a conductive network extending from the control unit to the plurality of nodes and vibrating devices configured for attachment to said nodes.

Referring to FIGS. 1 and 2, a person, or wearer 19, is donning an exemplary therapeutic apparel article 10 having a plurality of vibrating devices 18 attached thereto. The therapeutic apparel sock 22 is pulled up over the wearers 19 amputated limb 92. A control unit 14 is also configured on the therapeutic article. The therapeutic apparel is a wearable article 12 in the form of a sock 22 that is pulled up over the amputated arm of the wearer. As shown in FIG. 2, the exemplary wearable fabric article 12 has an interior volume 27 for extending over the amputate limb. The wearable fabric article has an inside surface 24 and an outside surface 26. The plurality of vibrating devices 18, 18' are attached to nodes 15 configured on the outside surface of the wearable fabric article. The vibrating devices 18 are detachably attachable to the nodes. The control unit 14 is also detachably attachable to the wearable fabric article and comprises a power source 40 and a user input feature 42. The control unit has an interface 44 that couples the control unit to the wearable fabric article 12 and to the conductive network, as shown in FIG. 3. The therapeutic apparel sock comprises an inflatable bladder 60 that is inflated by the inflator 62, as shown in FIG. 2.

As shown in FIG. 1, a wearable fabric article 12 has a plurality of light elements 200 that emit light and may produce a light display including flashing and/or colored lights. The light display may be configured to distract the wearer from their pain or discomfort. The light elements may be incorporated into any of the wearable fabric article embodiments shown throughout the figures but may not be shown for ease of illustration of other features.

As shown in FIG. 3, a conductive network extends from the control unit and provides electrical power to the vibrating devices 18. The conductive neatwork extends to each of the nodes 15 and delivers electrical power to the vibrating devices 18 when they are attached to the nodes 15. The exemplary nodes shown in FIG. 3 comprise an electrical supply portion 52 and an electrical return portion 54 in the form of snaps 50. The vibrating device 18 is configured with a node interface 80 comprising an electrical supply portion 82 and an electrical return portion 84, configured to couple with the snaps. When the vibrating device is attached to the node, the electrical supply portion 52 and the electrical return portion 54 of the node couple with the electrical supply portion 82 and an electrical return portion 84 of the node interface 80 to complete a circuit with the power supply 40 and power the vibrating device. Again, the node and the node interface of the vibrating device may be snaps configured to snap together when pressed into each other to form a detachably attachable coupling. The therapeutic apparel article 10 of FIG. 3 is a sock having an open end 29 and a closed end 28 that forms an interior volume 27 for receiving a limb.

Figure 4:
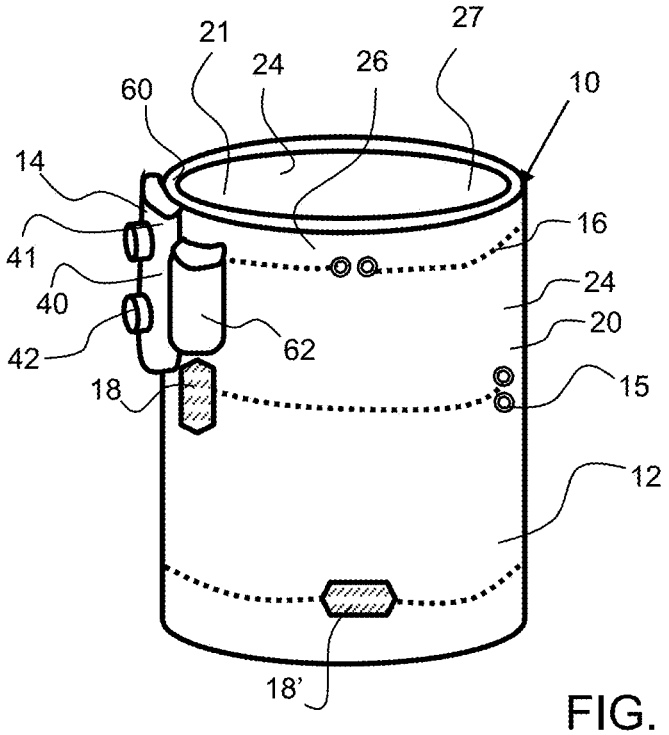
FIG. 4 shows an exemplary therapeutic apparel article that is a sleeve having a conduit therethrough.

As shown in FIG. 4, the exemplary therapeutic apparel article 10 is a sleeve 20 having a conduit 21 therethrough. The sleeve may be pulled up over a limb with the inside surface 24 sliding up against a wearers' limb. A sleeve type therapeutic apparel article 10 may be pulled over an arm, a leg, the torso and the like. As shown in FIG. 4, the inflatable bladder 60 is configured over substantially the entire sleeve 20, or at least 75% of the area of the sleeve, or at least 90% of the area of the sleeve. The inflator 62 is configured next to the controller 41 and power source 40.

Figure 5:
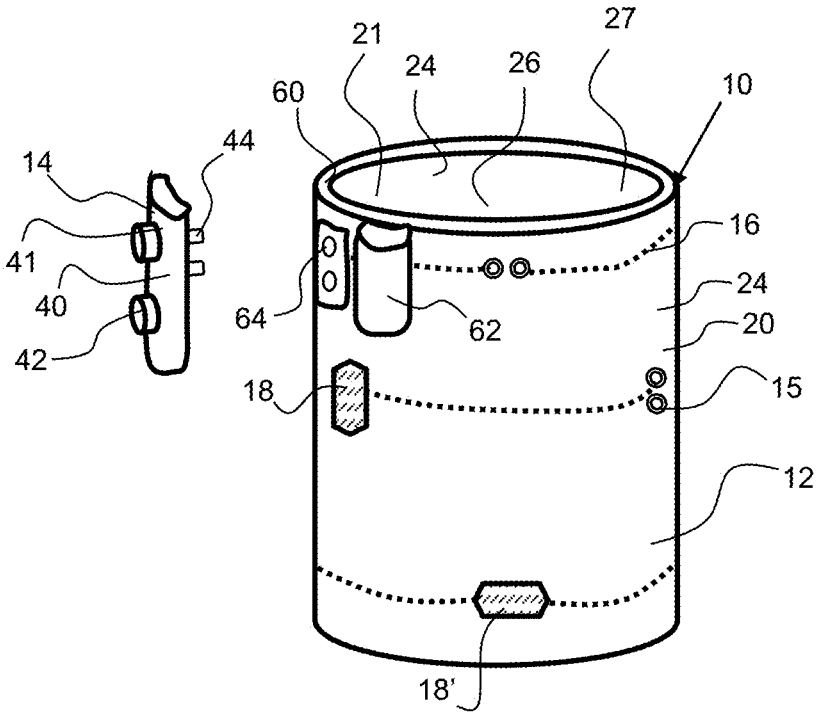
FIG. 5 show the exemplary therapeutic apparel article shown in FIG. 6 with the control unit detached from the interface to the control unit on the sleeve.

As shown in FIG. 5, the exemplary therapeutic apparel article 10 shown in FIG. 4 has the control unit 14 detached from the interface to the control unit 64 of the sleeve 20. The control unit has an interface 44 that is configured to couple the control unit and the power source 40 with the conductive network 16. With the control unit attached to the wearable fabric article 12, a supply of power from the power source can be delivered to the attached vibrating devices 18 through the conductive network 16 and the nodes 15. In addition, the control unit has user input features 42 that may change the power supply from the power source to the vibrating devices or may communicate with the vibration devices through the conductive network.

Figure 6:
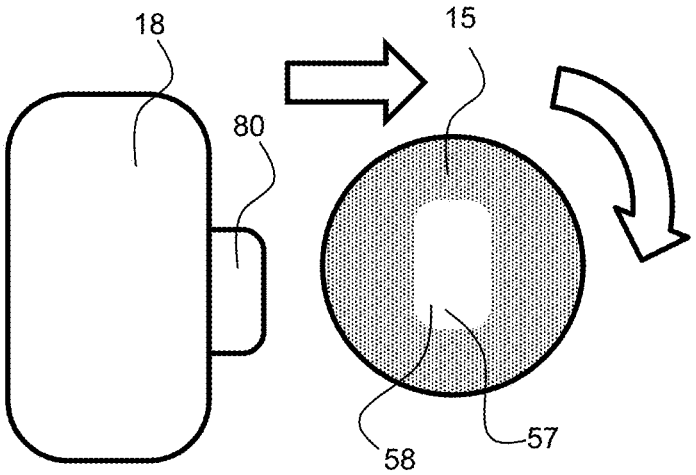
FIG. 6 shows an exemplary locking attachment interface for a vibrating device.

As shown in FIG. 6, an exemplary node 15 is configured with a locking feature 58 having a recess for receiving the node interface 80 of the vibrating device 18. The node interface is configured to extend into the recess and then when the vibrating device is turned or rotated with the node interface inserted into the recess, the vibrating device is locked to the node interface, whereby the vibrating device cannot be pulled from the node without first counter rotating the vibrating device.

Figure 7:
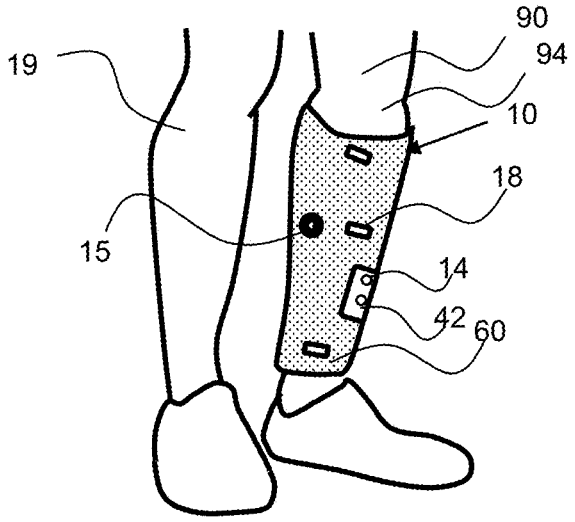
FIG. 7 shows a person donning a therapeutic apparel article sleeve on their leg.
Figure 8:
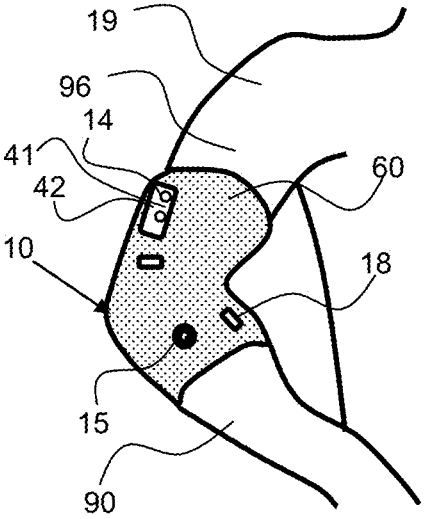
FIG. 8 shows a person donning a therapeutic apparel article sleeve on their arm.
Figure 9:
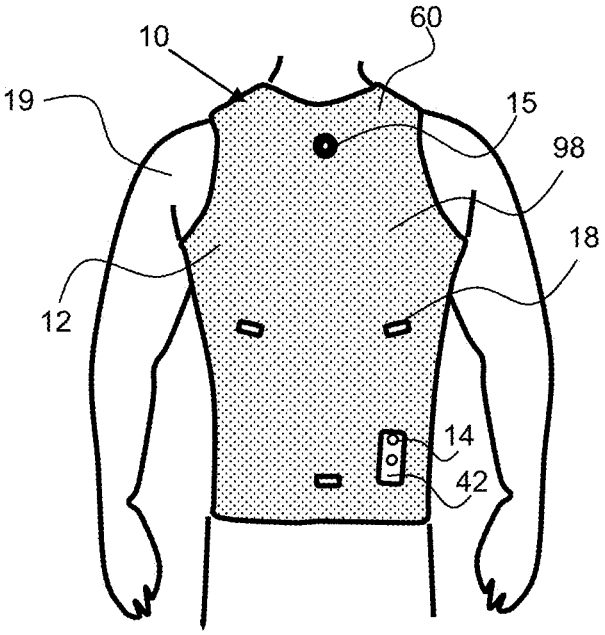
FIG. 9 shows a person donning a therapeutic apparel article sleeve on their torso.

As shown in FIGS. 7 to 9, exemplary therapeutic apparel articles 10 are being worn by users. In FIG. 7, the exemplary therapeutic apparel article 10 is a sleeve 20 that is pulled up over a wearer's limb 90, their leg 94. In FIG. 8, the therapeutic apparel article 10 is configured on the wearer's arm 96 and in FIG. 9 the therapeutic apparel article 10 is configured around the wearer's torso 98. Each of the exemplary therapeutic apparel articles 10 shown in FIGS. 7 to 9 may comprise an inflatable bladder 60 which may extend over a portion of the sleeve or article or substantially over the entire article, such as over more than 75% of the area of the article.

Figure 10:
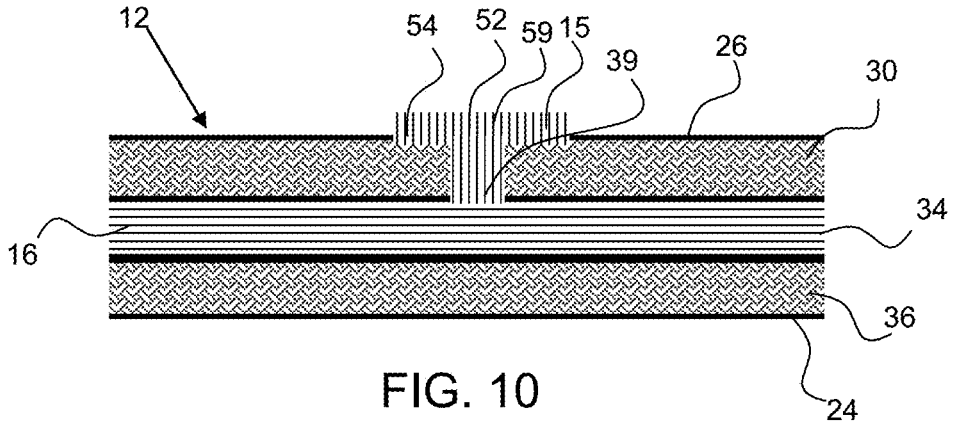
FIG. 10 shows a cross-section view of an exemplary wearable fabric article having an outer fabric layer, an inner fabric layer and a conductive network therebetween.

As shown in FIG. 10, an exemplary wearable fabric article 12 has an outer fabric layer 30, an inner fabric layer 36 and an interface layer 34 comprising a conductive network 16 therebetween. The outer fabric layer 30 extends to and forms part of the outside surface 26 of the wearable fabric article 12, and the inside fabric layer 36 extends to and forms part of the inside surface 24 of the wearable fabric article 12. The conductive network 16 provides a supply of power to the node 15 through a connection portion 39 from the conducive network and the node 15. The node has an electrical supply portion 52 and an electrical return portion 54. A node 15 may comprise an electrically conductive patch 59 that conducts electrical power from the conductive network.

Figure 11:
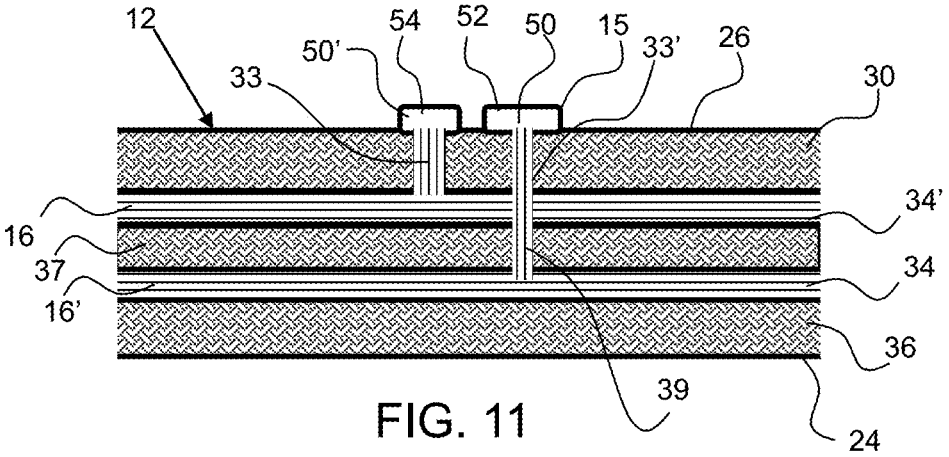
FIG. 11 shows a cross-section view of an exemplary wearable fabric article having an electrical supply snap and an electrical return snap as a node.
Figure 12:
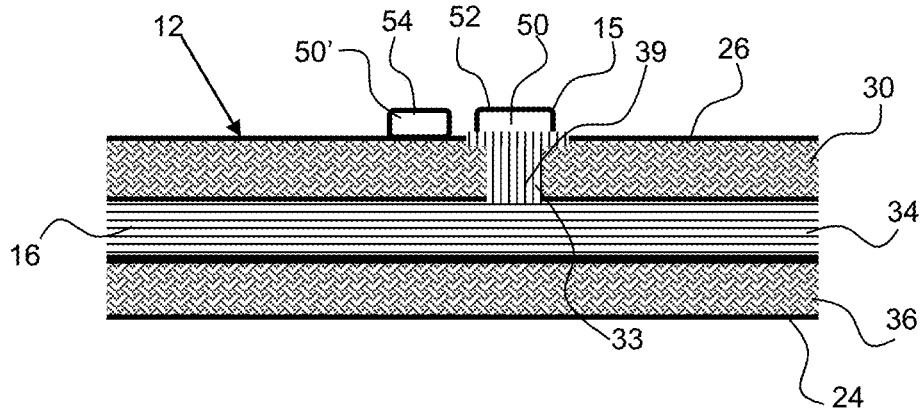
FIG. 12 shows a cross-section view of an exemplary wearable fabric article having snaps as a node.

As shown in FIG. 11, an exemplary wearable fabric article 12 has an electrical supply snap 52 and an electrical return snap 54 as part of a node 15. The connection portion 39 comprises electrical leads 33, 33' from the conductive network 16. In this embodiment, the conductive network 16 comprises two separate interface layers 34, 34', one for electrical supply and one for electrical return, respectively. A separator layer 37 extends between the two interface layers. The interface layers may be conductive fabric and/or electrical leads, such as insulated electrical wires that may be interwoven with the fabric.

As shown in 12, the exemplary wearable fabric article 12 has snaps 50 as a node. The electrical supply portion 52 is coupled electrically with the conductive network 16 by a connection portion 39, such as an electrical lead.

Figure 13:
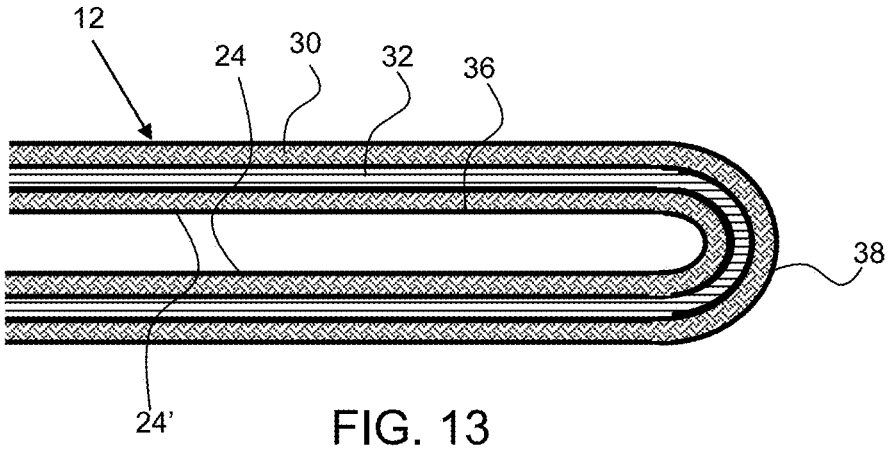
FIG. 13 shows an exemplary wearable fabric that is folded over with the inside surfaces facing parallel with each other.
Figure 14:
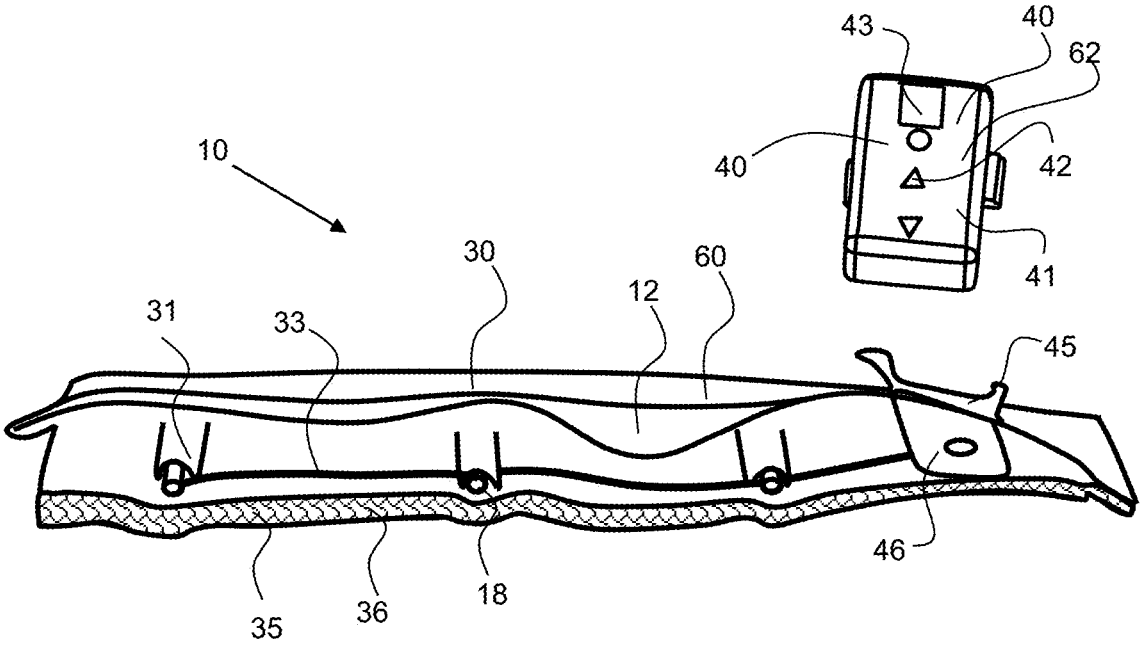
FIG. 14 shows a perspective view of an exemplary therapeutic apparel article having a plurality of vibrating devices configured in pockets between an outer fabric layer and inner fabric layer and a detachable controller that clips into a docking station coupled to the wearable fabric article.

As shown in FIG. 13, the exemplary wearable fabric article 12 is folded over with the inside surfaces 24, 24' extending parallel with each other. As described herein, an exemplary wearable fabric article is supple and may be folded over upon itself, with inside surface parallel and touching each other, and not be damaged.

A locking feature, as used herein, required two or more separate motions to detach the vibrating device from the attachment node, such as pushing in and rotating to lock to insert and counter rotating and pulling out to detach.

Referring now to FIGS. 14 to 21, an exemplary therapeutic apparel article 10 has a plurality of vibrating devices 18 configured with a wearable fabric article 12 and a controller 14, the controller 41 is detachably attachable to a docking station 45 that is coupled to the wearable fabric article 12. The vibrating devices are configured in pockets 31 between an outer fabric layer 30 and inner fabric layer 36, and the detachable controller 41 clips into the docking station 45 coupled to the wearable fabric article 12. An electrical lead 33 extends from the docking station to the vibrating devices 18 and the docking stations has an electrical supply portion 52 and return portion 54 of contact that couples with the controller 41. The controller 41 is detachably attachable to the docking station 45 and may simply click into the docking station, wherein the docking station has a living hinge or flexible portion to receive and retain the controller. The controller may comprise a power source 40, such as a battery or outlet coupling to provide power to the vibrating devices. The docking station is configured on the outside of the outer fabric layer 30 and the docking retainer 46 is configured inside of the outer fabric layer, or between the outside fabric layer and the inside fabric layer 36. One or more apertures and retainers may extend though the outer fabric to retain the docking station to the docking retainer. The vibrating devices 18 are retained in pockets in the wearable fabric article 12 and as shown these pockets are between the outer and inner fabric layers. The wearable fabric article may have a fastener 35, such as a hook-and-loop fastener, that extends along at least a portion of the length to enable the wearable fabric article to be opened to remove the vibrating devices, or relocate the vibrating devices in different pockets. The wearable fabric article may have a plurality of pockets to enable a user to place the vibrating devices in a desired location. The inflatable bladder 60 extends along the length and along one side, opposing the opening side, of the wearable fabric article 12. This configuration of the inflatable bladder will allow the bladder to extend around a user's limb when the therapeutic apparel article is wrapped around the user's limb. The inflator is configured with the controller 41 and the user may use the user input feature 42 to set a desired pressure.

Figure 15:
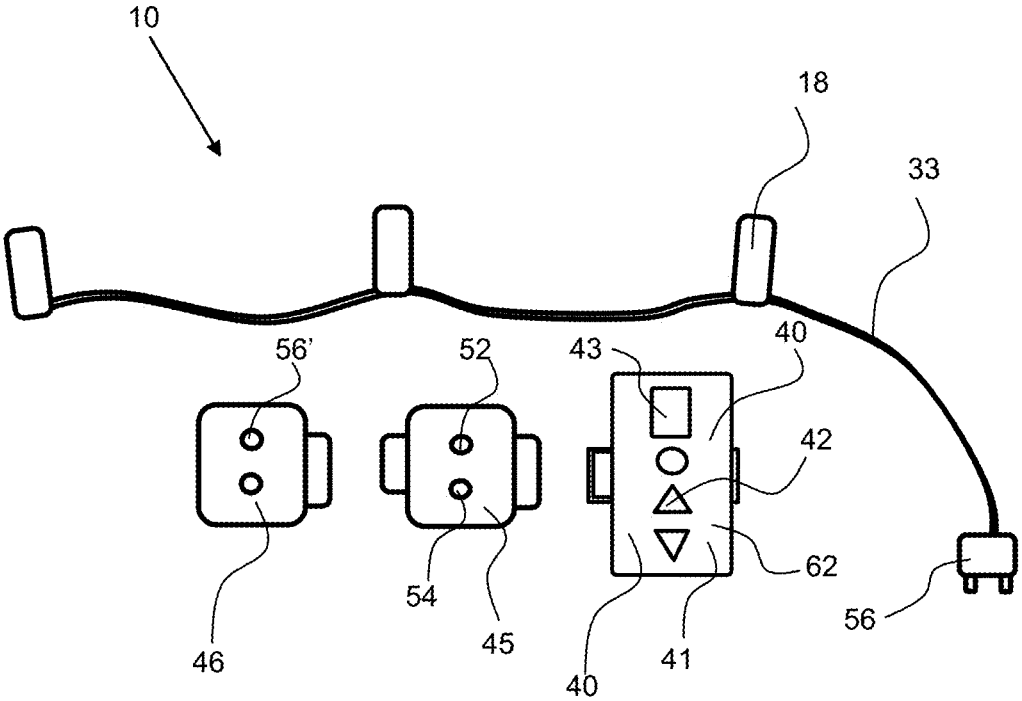
FIG. 15 shows an exemplary controller, docking station and docking retainer that couple with electrical leads to provide power and control to the vibrating devices.

As shown in FIG. 15, an exemplary controller 41, docking station 45 and docking retainer 46 are configured to couple with electrical leads 33 to provide power and control to the vibrating devices 18. The electrical leads 33 terminate with an electrical connector 56 that may be coupled with the electrical connector 56' of the docking retainer 46. The entire power and control system may be detached from the wearable article 12 to enable the wearable article to be washed.

Figure 16:
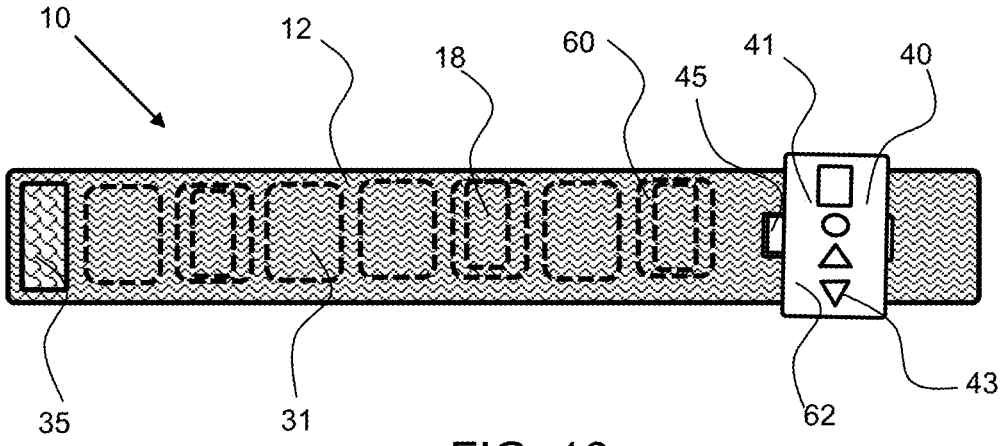
FIG. 16 shows a top view of an exemplary therapeutic apparel article having a plurality of vibrating devices configured in pockets between an outer fabric layer and inner fabric layer and a detachable controller that clips into a docking station coupled to the wearable fabric article.
Figure 17:
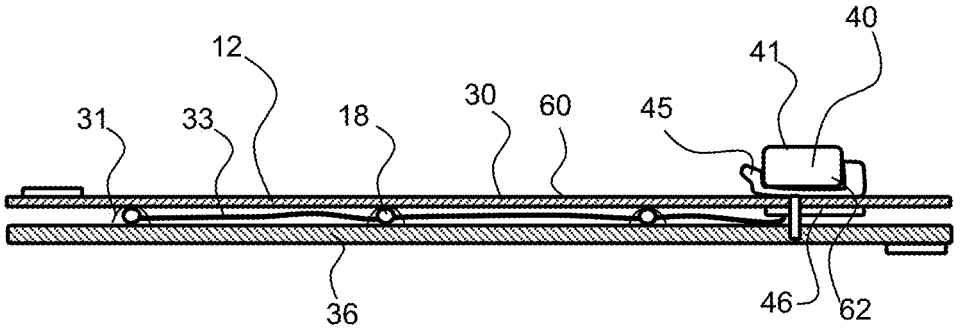
FIG. 17 shows a side cross-section view of an exemplary therapeutic apparel article having a plurality of vibrating devices configured in pockets between an outer fabric layer and inner fabric layer and a detachable controller that clips into a docking station coupled to the wearable fabric article

As shown in FIGS. 16 and 17, an exemplary therapeutic apparel article 10 has a plurality of vibrating devices 18 configured in pockets 31 between an outer fabric layer 30 and inner fabric layer 36. A detachable controller 41 is clipped into a docking station 45 that is coupled to the wearable fabric article by a docking retainer 46. The docking retainer is configured between the outer and inner fabric layers. Electrical leads 33 extend from the docking station to the vibrating devices. The inflatable bladder 60 extends along the substantially the entire area of the sleeve and is configured on an outer portion, whereby inflation of the inflatable bladder presses the vibrating devices against the inner fabric, or against the wearer of the fabric article. The inflator is configured with the controller 41 and the user may use the user input feature 42 to set a desired pressure.

Figure 18:
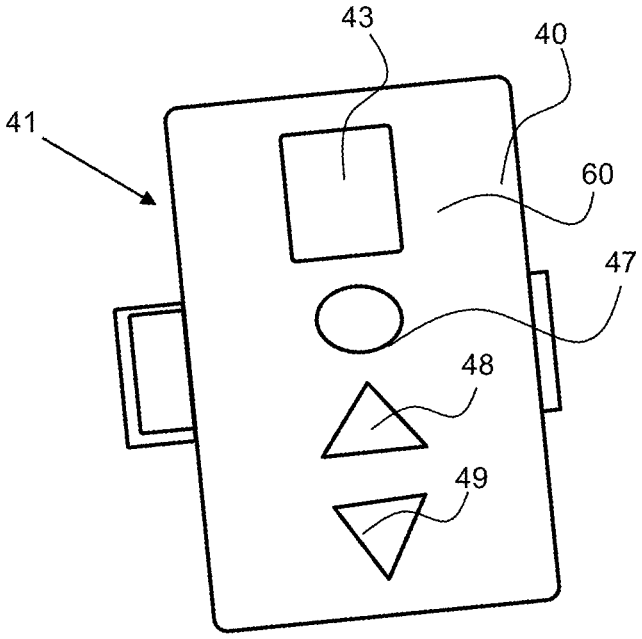
FIGS. 18 and 19 show a top view of an exemplary controller having a plurality of user interface controls and a display.
Figure 19:
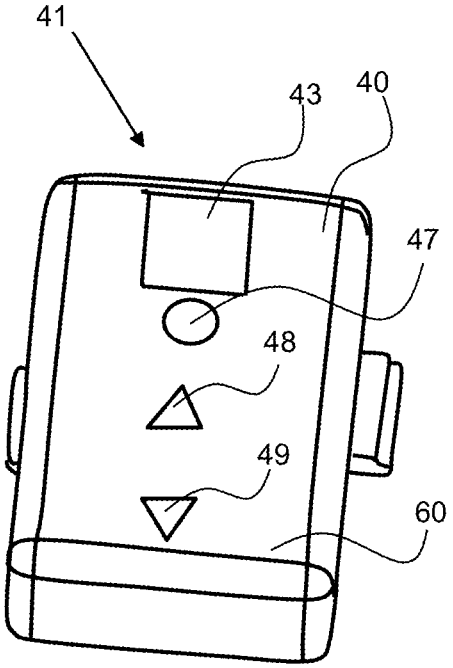
Figure 20:
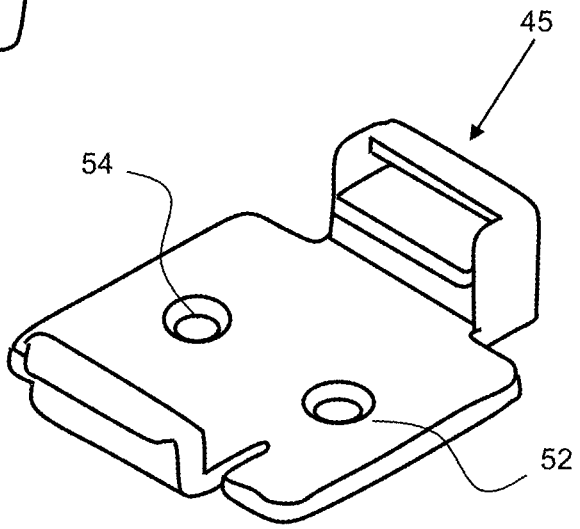
FIG. 20 shows an exemplary docking station having electrical supply and return portions that couple the controller with the electrical leads to the vibrating devices.

Referring now to FIGS. 18 to 20, an exemplary controller 41 has a plurality of user input features 42 and a display. The user input features include an on/off input 47, an increase input 48 and a decrease input 49. The increase and decrease input features may change a vibrating level and/or frequency of vibration. As shown in FIG. 20, a docking station 45 comprises an electrical supply portion 52 and electrical return portion 54, which are contacts that couple a power source 40 to the vibrating devices.

Figure 21:
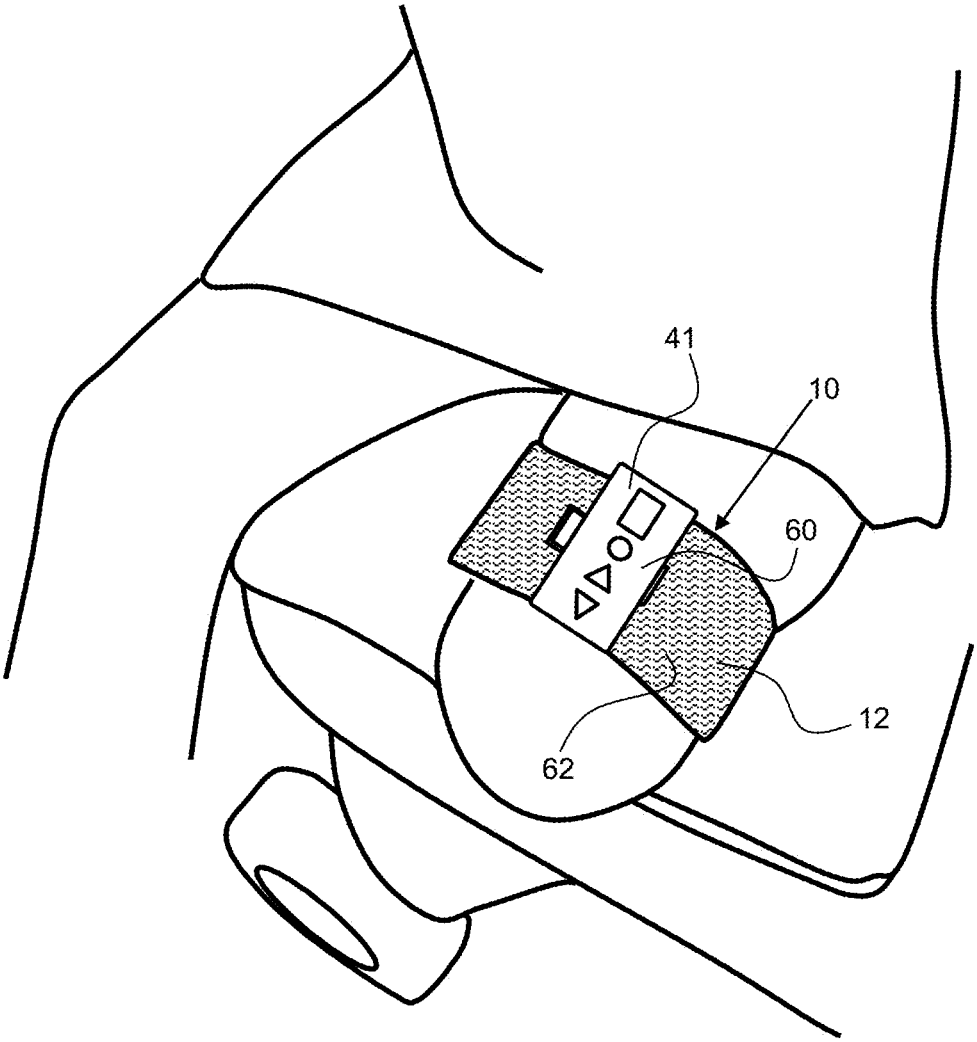
FIG. 21 shows a person with an exemplary therapeutic apparel article strapped around their leg.

As shown in FIG. 21, a person has an exemplary therapeutic apparel article 12 strapped around their leg. The controller is detachably attachable and the wearable fabric article has a fastener to enable removal of the vibrating devices and electrical leads to enable the wearable fabric article to be washed.

Figure 22:
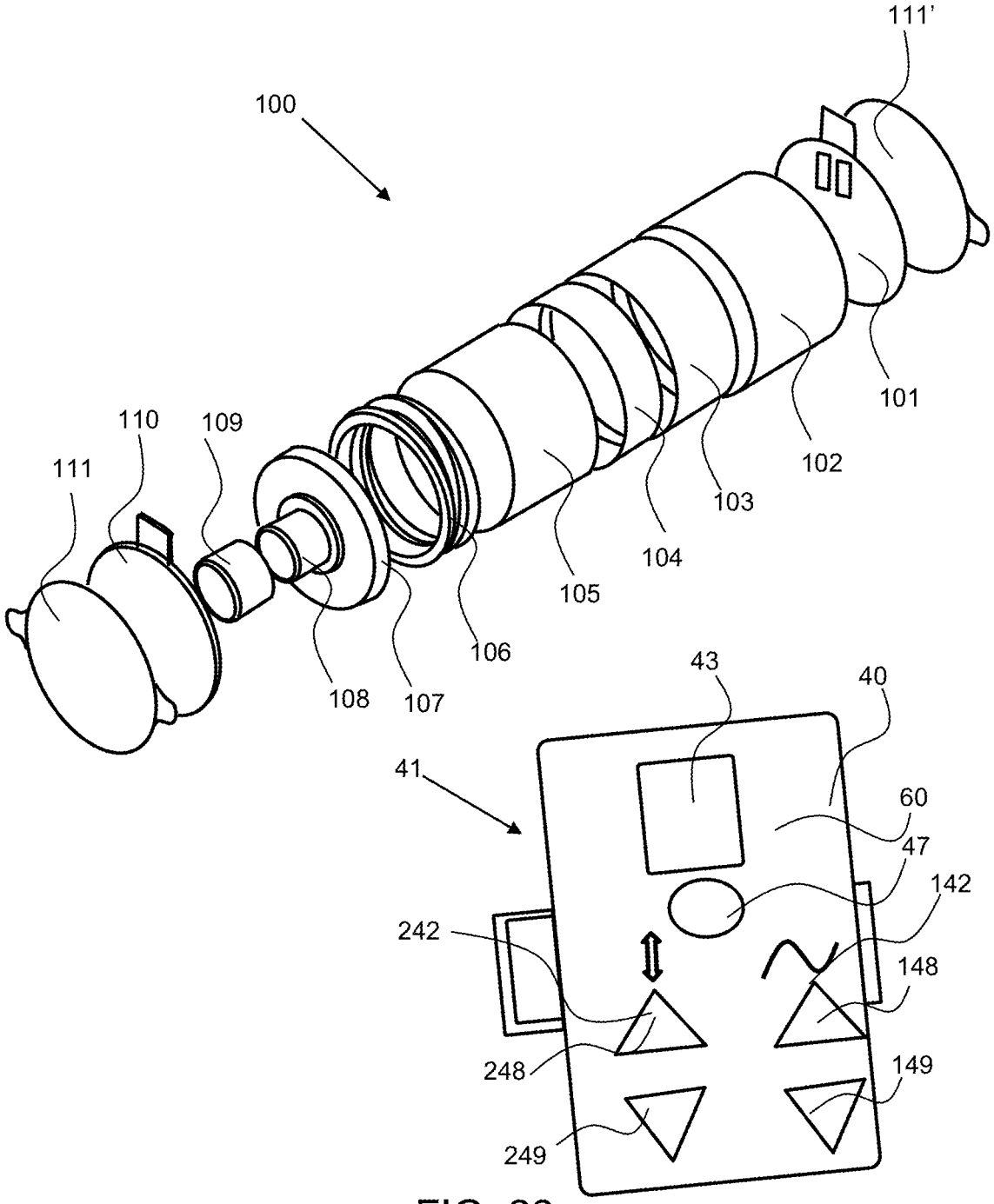
FIG. 22 is an exploded view of an exemplary smart vibrating motor.
Figure 23:
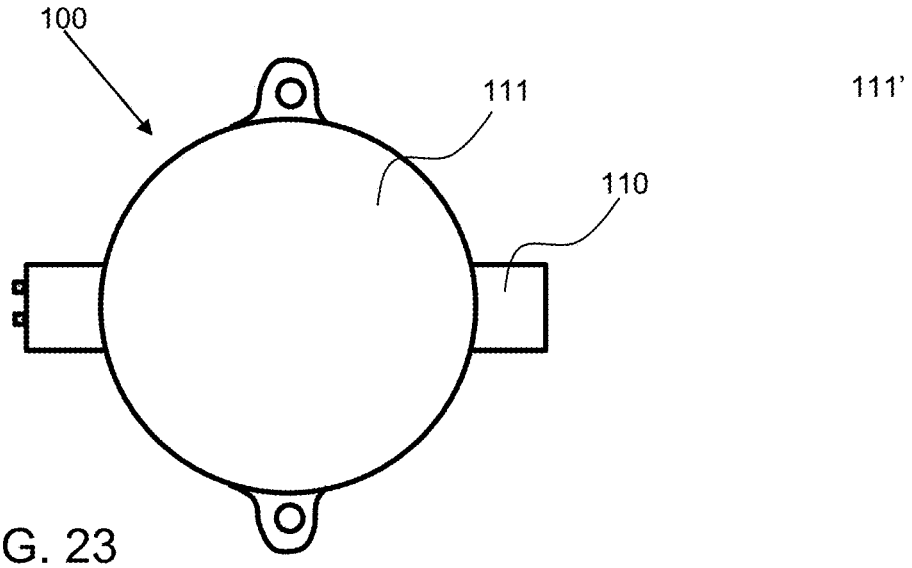
FIG. 23 is a top/bottom view of the exemplary smart vibrating motor shown in FIG. 22.
Figure 24:
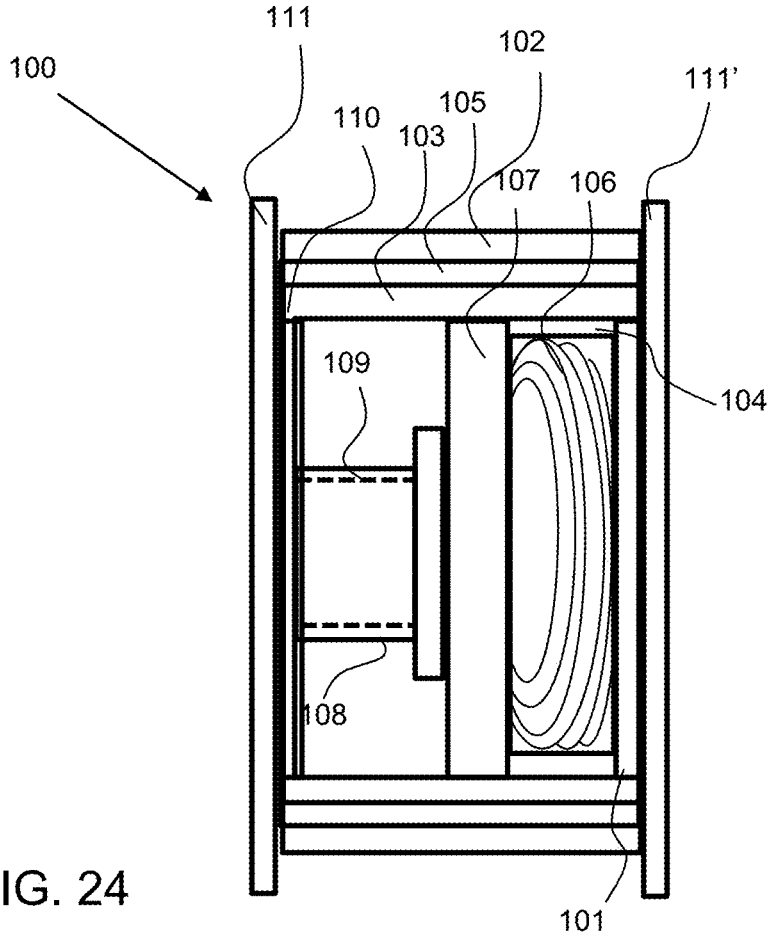
FIG. 24 is a lateral cross-section through the exemplary smart vibrating motor shown in FIG. 22.

Referring now to FIGS. 22 to 24, an exemplary linear resonance actuator 100 incorporates a shape memory alloy spring 106, that is heated by a heater 104 to change the stiffness of the spring and therefore change the amplitude and/or frequency of vibration. A voice coil 109 creates a magnetic field that creates a force on the magnet 108, such as a permanent magnet. The voice coil may receive an electrical signal having a frequency and the attraction and repulsion magnetic force created on the magnet may follow this frequency and/or amplitude of the magnetic field created. The magnet is coupled with the actuator mass 107 and the control signal sent to the voice coil moves the mass according to the frequency and amplitude of the magnetic field. The actuator mass is actuated back and forth by the changing magnetic field and the shape memory alloy spring is configured between the actuator mass and the end plate 111' to translate the motion to the end plate. A change in the stiffness of the spring will change the frequency and/or amplitude of motion of the end plate. A heater 104 is controlled by the heater controller 101 and may be used to adjust the temperature of the shape memory alloy spring and therefore the stiffness. A barrier sleeve 105 extends around the heater and a thermal insulation layer 103 is configured between the barrier sleeve 105 and a actuator cover 102. The voice coil controller 110 controls the voice coil to change the frequency and magnitude of the magnetic field.

It is to understood that one or more shape memory alloy springs may be utilized in a vibrating device, such as an LRA, and may be configured in series or parallel and may have different sizes, spring constants, and may be made out of different alloys and thereby have different changes in stiffness as a function of temperature. For example, a series arrangement of shape memory alloys springs may be used wherein a first spring becomes stiffer at a first transition temperature but the second spring does not change at a first transition temperature and at a second, higher transition temperature, both the first and second shape memory alloy springs have a different stiffness from ambient conditions. This arrangement of two or more springs, which may be shape memory alloy springs or conventional springs may enable a smoother transition from one frequency or amplitude to another.

A linear resonance actuator may be coupled with a controller 41 that has separate user input features for frequency and amplitude. As shown, the user input feature 42 on the controller 41 has an amplitude input feature 242 that has an amplitude up 248 and an amplitude down 249 control button and a frequency input feature 142 that has a frequency up 148 and a frequency down 149 control button. The frequency and amplitude may be decoupled by the change in spring stiffness, or spring constant, as a function of changing the temperature of the shape memory alloy spring.

Figure 25:
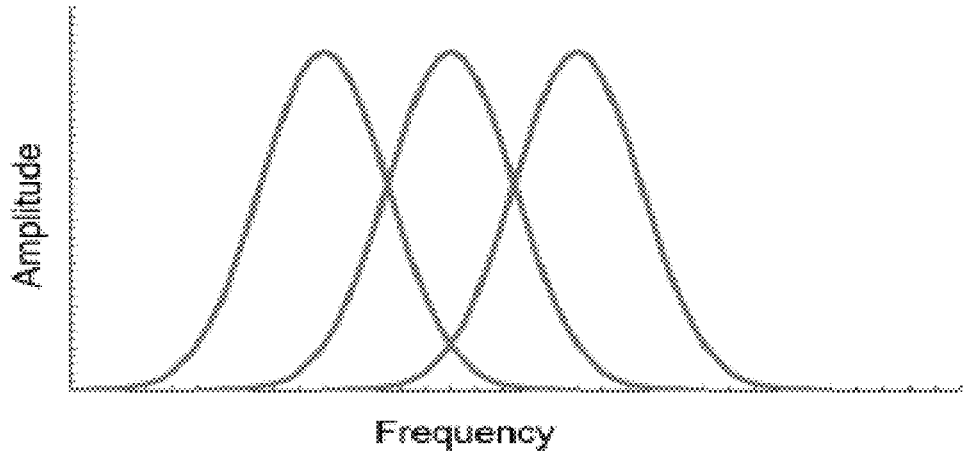
FIG. 25 is a graph of amplitude versus frequency produced by an exemplary vibrating motor.

FIG. 25 is a graph of amplitude versus frequency produced by an exemplary vibrating motor.

Figure 26:
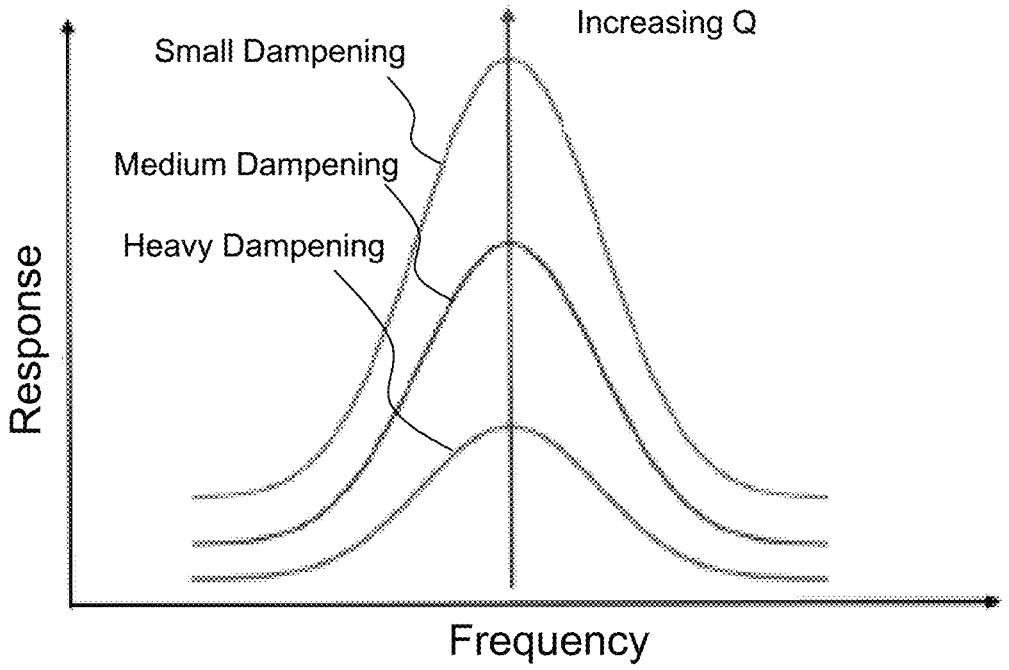
FIG. 26 is a graph of response versus frequency.

FIG. 26 is a graph of response or amplitude versus frequency. An LRA may preferably operate at a frequency that is a resonance frequency of the spring and with a shape memory alloy this resonance frequency can be changed by heating. The small, medium and heavy dampening response lines may be as a result of heating a shape memory alloy spring in an LRA.

It will be apparent to those skilled in the art that various modifications, combinations and variations can be made in the present invention without departing from the spirit or scope of the invention. Specific embodiments, features and elements described herein may be modified, and/or combined in any suitable manner. Thus, it is intended that the present invention cover the modifications, combinations and variations of this invention provided they come within the scope of the appended claims and their equivalents.

What is claimed is:

1. A method of applying vibration therapy comprising:

a) providing a therapeutic apparel article system comprising:

a wearable fabric article comprising:

i) an outer fabric layer;

ii) an inner fabric layer;

iii) a plurality of pockets configured in an interior between the outer and inner fabric layers;

iv) a fastener that detachably attaches the outer and inner fabric layers together and that allows access to said interior;

a detachably attachable vibrating device that is configured in one of said plurality of pockets, said vibration device comprising: a linear resonance actuator comprising:

an end plate;

a voice coil;

a magnet;

a linear resonance mass that is coupled to the magnet and configured to move in response to a magnetic field generated by said voice coil;

at least one shape memory alloy spring configured between said linear resonance mass and said end plate;

a heater configured to heat said at least one shape memory alloy spring;

wherein said at least one shape memory alloy spring has a stiffness that changes with temperature and wherein a frequency and an amplitude of the vibrating device are independently adjustable;

an electrical lead extending from the vibrating device to a detachably attachable controller;

wherein the detachably attachable vibrating device and electrical lead are configured to detachably attach to the wearable fabric article;

the detachably attachable controller comprising:

i) a power source;

ii) a user input feature comprising:

a frequency input feature configured to; and an amplitude input feature;

c) donning the wearable fabric article;

c) turning on vibrating device using the user input feature;

d) setting a first frequency and a first amplitude to initiate a first vibration therapy;

changing the first frequency while the first amplitude or changing the first amplitude while maintain the first frequency.

2. The method of claim 1, further comprising a docking station coupled to the outer fabric layer and configured to receive and retain the controller.

3. The method of claim 2, wherein the controller comprises the power source and wherein the docking station comprises an electrical supply portion and electrical return portion that couple with the power source to provide power to the vibrating device through the electrical leads.

4. The method of claim 1, wherein the wearable fabric article is flexible and can be folded over without damage to the wearable fabric article.

5. The method of claim 1, wherein the wearable fabric is a sock having an interior volume.

6. The method of claim 1, wherein the wearable fabric is a sleeve having an interior conduit.

7. The method of claim 1, wherein the electrical lead comprise insulated electrical wires that are integrated into the wearable fabric article.

8. The method of claim 1, further comprising an inflatable bladder.

9. The method of claim 8, wherein the inflatable bladder extends substantially over the wearable fabric article and extends over at least 75% of a contact surface area of the wearable fabric article.

10. The method of claim 8, wherein the inflatable bladder is configured outside of the vibrating device, whereby inflation of the inflatable bladder presses the vibrating device against the inner fabric layer.

11. The method of claim 1, wherein donning the wearable fabric article comprising donning it around an amputated limb or residual limb.

12. The method of claim 11, wherein the wearable fabric is a sock having an interior volume, and wherein said limb is configured in the interior volume.

13. The method of claim 11, wherein the wearable fabric article further comprises an inflatable bladder and wherein said inflatable bladder is pressurized to exert compression on said limb.

14. The method of claim 13, wherein the vibrating device is pressed against the limb by said inflatable bladder.

15. The method of claim 14, wherein the inflatable bladder comprises a fluid that is heated above 38° C.

16. The method of claim 11, wherein the therapeutic apparel article further comprises a light element configured to produce a light display.

17. The method of claim 1, wherein the therapeutic apparel article further comprises a light element configured to produce a light display.

18. The method of claim 1, wherein the at least one shape memory alloy spring comprises a first shape memory alloy spring and a second shape memory alloy spring.

19. The method of claim 18, wherein the first shape memory alloy spring has a transition temperature that is different by at least 5° C. from a transition temperature of the second shape memory alloy spring.

* * * * *